US006860309B2

(12) United States Patent
Hartman et al.

(10) Patent No.: US 6,860,309 B2
(45) Date of Patent: Mar. 1, 2005

(54) SPLICING SYSTEM AFFORDING A CONTINUOUS WEB MATERIAL SUPPLY FOR AN APPLICATOR

(75) Inventors: James N. Hartman, Parma, ID (US); Peter M. Downie, Vancouver, WA (US)

(73) Assignee: Adalis Corporation, Vancouver, WA (US)

( * ) Notice: Subject to any disclaimer, the term of this patent is extended or adjusted under 35 U.S.C. 154(b) by 95 days.

(21) Appl. No.: 10/003,519

(22) Filed: Oct. 30, 2001

(65) Prior Publication Data

US 2002/0079042 A1 Jun. 27, 2002

Related U.S. Application Data

(63) Continuation-in-part of application No. 09/703,968, filed on Nov. 1, 2000, now abandoned.

(51) Int. Cl.[7] ..... B65H 21/00

(52) U.S. Cl. ..... 156/505; 156/507; 156/543; 83/553; 242/551; 242/556.1

(58) Field of Search ..... 156/157, 159, 156/251, 267, 269, 270, 304.1, 324, 353, 502, 504, 505, 507, 511, 515, 516, 530, 543, 544, 555; 83/553; 269/218; 100/264, 271; 242/551, 556.1

(56) References Cited

U.S. PATENT DOCUMENTS

| | | | | |
|---|---|---|---|---|
| 2,987,108 A | | 6/1961 | Kilmartin | |
| 3,618,483 A | | 11/1971 | Helm | |
| 3,660,208 A | | 5/1972 | Hubbard | |
| 3,738,587 A | * | 6/1973 | Cristiani | 242/554.2 |
| 3,886,033 A | | 5/1975 | MacDonald et al. | |
| 3,894,905 A | | 7/1975 | Ehlscheid | |
| 3,939,032 A | | 2/1976 | Taitel et al. | |
| 3,957,570 A | | 5/1976 | Helm | |

(List continued on next page.)

FOREIGN PATENT DOCUMENTS

| | | |
|---|---|---|
| DE | 4209262 | 1/1992 |
| EP | 0 776 848 A2 | 11/1995 |
| EP | 0 691 267 | 1/1996 |
| EP | 1 132 325 | 9/2001 |
| GB | 2 143 802 | 2/1985 |
| GB | 2 315 041 | 1/1998 |
| JP | 8-309890 | 11/1996 |
| WO | WO 96/35574 | 11/1996 |
| WO | WO 00/15729 | 3/2000 |
| WO | WO 02/39219 A2 | 5/2002 |

*Primary Examiner*—Christopher A. Fiorilla
*Assistant Examiner*—Cheryl N. Hawkins
(74) *Attorney, Agent, or Firm*—Klarquist Sparkman, LLP

(57) ABSTRACT

An apparatus and method for providing continuous supply of transfer tape to an applicator machine. The method includes unwinding the tape from the rolls to erase the roll memory in the tape, advancing the tape along a web path through knife elements to staging areas and past pinch rollers to the applicator. A second tape is placed on the staging plate for splicing to the first tape at the pinch roller. The first tape is cut and the second tape is advanced to the applicator.

24 Claims, 6 Drawing Sheets

U.S. PATENT DOCUMENTS 4,106,974 A 8/1978 Hirsch
4,120,034 A 10/1978 Fisk et al.
4,120,739 A 10/1978 Peeters et al.
4,157,934 A 6/1979 Ryan et al.
4,181,558 A 1/1980 Neubronner
4,190,483 A 2/1980 Ryan et al.
4,332,635 A 6/1982 Holbrook et al.
4,364,787 A 12/1982 Radzins
4,405,066 A 9/1983 Roccaforte
4,450,039 A 5/1984 Salvucci et al.
4,455,190 A 6/1984 Bianchetto et al.
4,481,053 A 11/1984 Tokuno et al.
4,506,816 A 3/1985 Roccaforte
4,580,709 A 4/1986 Roccaforte
4,589,943 A 5/1986 Kimball et al.
4,668,328 A 5/1987 Kyytsonen
4,720,320 A 1/1988 Niemi
4,722,489 A 2/1988 Wommer
4,795,510 A 1/1989 Wittrock et al. ..... 156/64
4,917,327 A 4/1990 Asbury et al. ..... 242/156
4,925,521 A 5/1990 Asbury et al.
5,021,111 A 6/1991 Swenson
5,029,768 A 7/1991 Asbury et al.
5,078,311 A 1/1992 Taguchi et al.
5,224,405 A 7/1993 Pohjola
5,415,716 A 5/1995 Kendall
5,429,576 A 7/1995 Doderer-Winkler
5,501,763 A 3/1996 Ueda et al.
5,573,626 A 11/1996 Rossini et al. ..... 156/361
5,624,526 A 4/1997 Perecman et al.
5,692,699 A 12/1997 Weirauch et al. ..... 242/556.1
5,775,629 A 7/1998 Cyr
5,782,736 A 7/1998 Brizzi et al.
5,839,634 A 11/1998 Pollard et al.
5,913,991 A 6/1999 Kubota et al. ..... 156/64
5,947,360 A 9/1999 Frank
6,007,660 A 12/1999 Forkert ..... 156/256
6,013,148 A 1/2000 Bluemle
6,172,698 B1 1/2001 Iwata et al.
6,173,876 B1 1/2001 Sano et al.
6,244,321 B1 * 6/2001 Sakamoto ..... 156/504
6,475,325 B1 11/2002 Parrish et al.
6,488,228 B2 12/2002 Davies et al.
2002/0038686 A1 4/2002 Parrish et al.
2002/0050324 A1 5/2002 Middelstadt et al.
2002/0059982 A1 5/2002 Hartman et al.
2002/0079045 A1 6/2002 Parrish et al.

* cited by examiner

SPLICING SYSTEM AFFORDING A CONTINUOUS WEB MATERIAL SUPPLY FOR AN APPLICATOR

CROSS REFERENCE TO RELATED APPLICATION

This application is a continuation-in-part of U.S. patent application Ser. No. 09/703,968, filed Nov. 1, 2000, which is now abandoned.

BACKGROUND

This invention relates to a system for providing a continuous supply of web material to an applicator. This means a splicing system to add the leading end of a fresh roll of web material to the trailing end of an exhausted supply roll. The splicing system has to make a rapid and secure splice so the leading end of the new roll will be drawn into the applicator along a path created for the advance of the web material to the applicator without stopping the supply of web material to the applicator. In one aspect the present invention provides an improved splicing system using a splicing tape on a backing. The splicing system is adapted to use a splicing tape to make positive contact between the web material ends without special end structures, and the system uses sufficient tape tension sensing and braking mechanisms to avoid tensions that would break the tape or stop the tape while splicing the new roll to the expired supply roll.

The use of splices to join ends of rolls of web material exist. The art is replete with patents on the subject and on different ways of making the splice.

One such patent is the U.S. Pat. No. 4,917,327, (Asbury et al.), which discloses a splicing system for splicing the trailing end of one tape to the leading portion of another. The first tape 12 is provided at its trailing end with a pin element 16. A second tape 18 is provided at its leading end with a loop element 22. When the pin engages the loop, the tapes become linked, causing the trailing end of the first tape to pull the leading end of the second tape into the machine. The patent family includes U.S. Pat. No. 5,029,768 and Canadian Patent 1,280,097.

A splicing tape is known from U.S. Pat. No. 5,692,699 (Weirauch et al.) disclosing a tape with a splicing portion (1,2) and an attachment portion (10", 41). The tape disclosed has an attachment portion (10", 41) for attaching the splicing portion (1,2) and separating the splicing portion from the surface of the underlying layer. This patent is directed to a specific splicing tape for use with a roll of paper to attach the end of the roll to the outer wrap on the roll.

A splicing method is disclosed in U.S. Pat. No. 5,913,991 (Kubota et al.) for attaching a length of magnetic tape to a leader. The apparatus provides for aligning ends of the tapes with the ends of the leaders extending from a cassette, and splicing the ends using vacuum holders for the ends.

Another patent, U.S. Pat. 5,573,626, (Rossini et al.), discloses a tape splicing machine that can splice an adhesive tape in a supply roll to the lead end of the tape in a subsequent roll. The tapes 24 and 26 are guided to the splicing station and between the splicing rollers 212 and 252. The supply tape nearing its end and results in the triggering of the microswitch to actuate the solenoid 230. The roller 212 is carried toward the roller 252 where the lead end of tape 44 is positioned to contact the supply tape 42. When the splice is made, the tape 42 makes contact with the tape 44, the splice is made, and the tape 42 is cut. See columns 23 through 26. In column 24, beginning in line 56, the patent describes the manual set up necessary to make the next splice.

U.S. Pat. No. 5,624,526, (Perecman et al.), is also directed to a tape splicing apparatus that splices a second tape to a first tape "on the fly." The first tape is directed through a guide in the splicing apparatus where an applicator element is moved from a staging position toward the tape guide path to a splice position and then back to its staging position. The first tape is then cut and the machine readied for the subsequent splice.

SUMMARY

A splicing system affording the splicing of successive web materials from supply rolls to afford a continuous web to an applicator, includes the definition of the proper web path from supply roll spindles to the splicing station. The splicing station utilizes a pair of cutting systems, staging members, splicing rollers, and guide rollers defining a web path for a web from the splicing station to the applicator. The roll spindles, for placement of a first supply roll and second supply roll of web, and the rollers define the path of the web supply. Pressure sensitive splicing tape is placed in overlapping fashion on the end of the second web and extends therepast for engaging the present supply of the first web near the end thereof. The splicing tape is placed on the leading end of the second web from the second supply roll while on the staging plate. The staging plate is supported along the web path from either spindle and the web path is defined by a series of rollers that act to reverse the memory of the web when the web was in the wrapped condition of the supply roll. The memory of the web varies with the type of web construction. Therefore, in some instances, there may be no need for this reversal. The rollers guide and direct the tape from the roll to a predetermined web path. The splice is controlled by the use of a splicing tape placed upon the leading end of the second roll and is placed together with the free end of the second supply roll at the staging area and splicing junction. The splice is triggered by the actuation of power to operate the splicing rolls and an appropriate cutting knife to complete the splice. The power to trigger the splicing rollers, the staging area and knives can be generated from controls actuated in response to the tape position and by the splice completion and timer. Manual controls, as illustrated, actuate the elements by pneumatic power, and manual operation positions the splicing tape on the free end of the supply tape and places the splicing tape in the nip rollers that make the initial splice. Sensors can be employed to activate the splicing sequence and a programmable logic controller (PLC) can be used to interface with the pneumatic system.

The knives are positioned upstream from the staging area and are moveable in relation to the web path from a standby position to a cutting position in alignment with the supply web. The cutting edges of the knives are preferably at an angle to cut the tape. The knives are also positioned between guard blocks to avoid injury to personnel. Actuation of the knives is handled by pneumatic cylinders triggered by pneumatic control valves for directing the stored energy to the elements.

The method of the present invention affords the continuous delivery of a web to the applicator. The web can be a transfer tape that includes a backing, an adhesive composition disposed on a first surface of the backing, a release coating disposed on a second surface of said backing, the second surface being opposite the adhesive coated surface. Specifically, the web can include a layer of very tacky adhesive on a paper backing web. Such webs present a unique challenge when splicing. The first step of the method includes cracking the memory of the paper web backing from its curled condition to a straight line and reverse curve. Secondly, the second supply roll receives a length of splicing tape that includes a film backing with a coating of pressure sensitive adhesive in such a manner to extend beyond the end of the web material to engage the supply web with the adhesive coated side of the splicing tape directed inwardly of the two webs. The splicing tape is then joined to the supply web by pinching the free end of the splicing tape to the adjacent surface of the supply web. The supply web is then cut so the splicing tape and second web advance toward the applicator for applying the adhesive coated web material to an article.

BRIEF DESCRIPTION OF THE DRAWINGS

The present invention will be described with reference to the accompanying drawing wherein.

DETAILED DESCRIPTION

Figure 5:
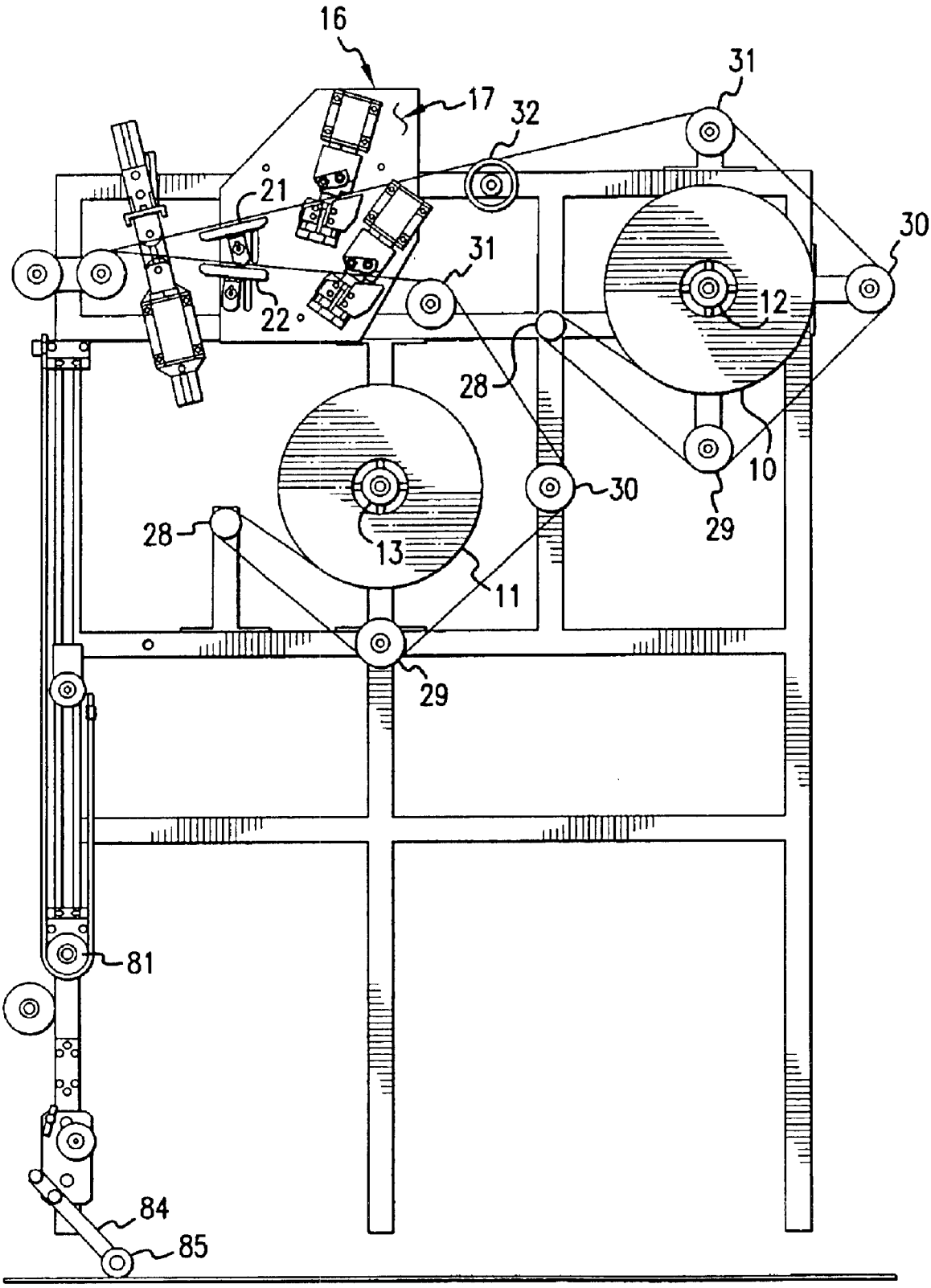
FIG. 5 is a front view of the splicing apparatus and applicator.

The present invention provides an improved apparatus and method for providing continuous web to an applicator, where the web is a "transfer tape" that includes an adhesive composition, preferably a very tacky pressure sensitive adhesive, disposed on a backing, preferably a paper backing. The backing is coated on opposite sides with a release composition, such as a silicone-based composition. The transfer tape is traversely wound on a core about six inches (15 cms.) long to provide added tape length in a roll. The supply rolls are illustrated in the accompanying drawing as 10 and 11, see FIG. 5. The supply rolls 10, 11 are supported on spindles 12 and 13 supported on a frame 15. Also, supported on the frame 15 is a support plate 16 upon which is mounted the splicing station 17 comprising: a pair of cutting knives 18 and 20 and a pair of staging plates 21 and 22 that are positioned to stage the free end of the second supply roll 11. The frame 15 also supports an extrusion forming a support bar 24 supporting the nip rollers forming a splicing area or element 25 of the splicing station 17.

Upstream from the cutting knives 18 and 20 are a plurality of advancing rollers 28, 29, 30, 31, which receive the tape from the supply roll 10 or 11. The series of rollers form means for placing a reverse curl in the tape to eliminate the memory in the paper wound convolutely and/or traversely on the roll core. The series of rollers comprise a first cylindrical roller 28 having a length equal to that of the cylindrical core of the traversely wound tape with an axis parallel to the axis of the spindle. The tape is moved about 120 degrees to about 190 degrees around the surface of the roller 28 to initially break the memory in the paper liner of the tape. As the adhesive coated tape is unwound from the roll, 10 or 11, where it is wound with the adhesive side inward, the paper liner engages the rollers 28, 29, 30, 31. The next pulley 29 has a concave surface with a fairly large radius, sometimes referred to as an "apple core pulley." Pulley 29 drives the tape toward a fixed straight line path. The third roller 30 is another concave pulley with a tighter radius, bringing the tape to the desired path, which is defined then by the fourth concave roller 31 of still smaller radius to the concave surface. As the tape leaves the roller 31, the memory in paper liner is removed, and the tape is straightened and moves along a straight path. The tape from the supply spindle 12 moves over an idler 32. From the roller 31 and idler 32, the tape is directed through the associated knife element 18 or 20. The tape is advanced around the pulleys with the adhesive surface disposed away from the surface of the pulleys. As mentioned above, some tape constructions may have less memory and thus may not require as much memory reversal effort.

Figure 1:
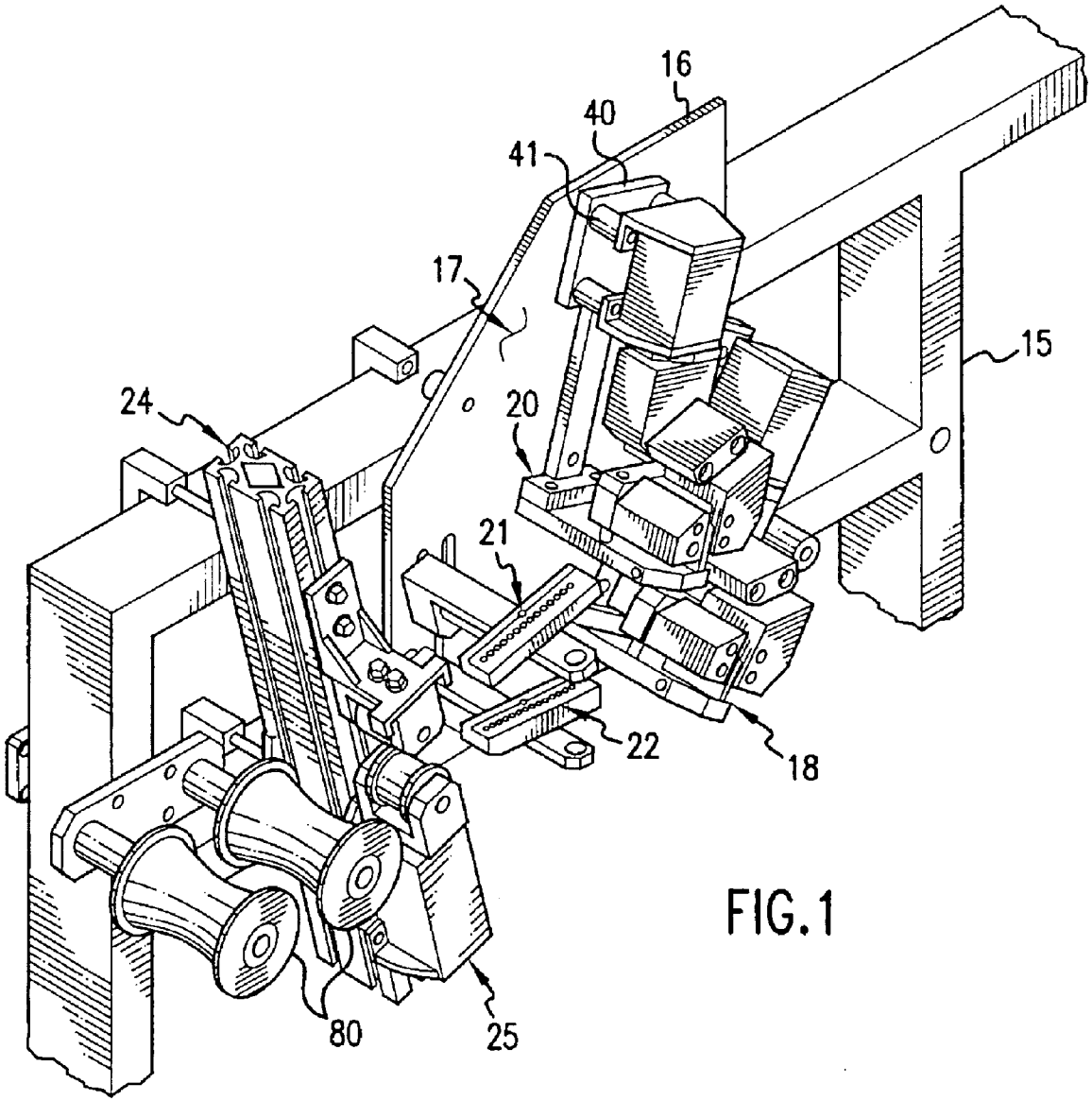
FIG. 1 is a fragmentary perspective view of the splicing station of the apparatus of the present invention.
Figure 2:
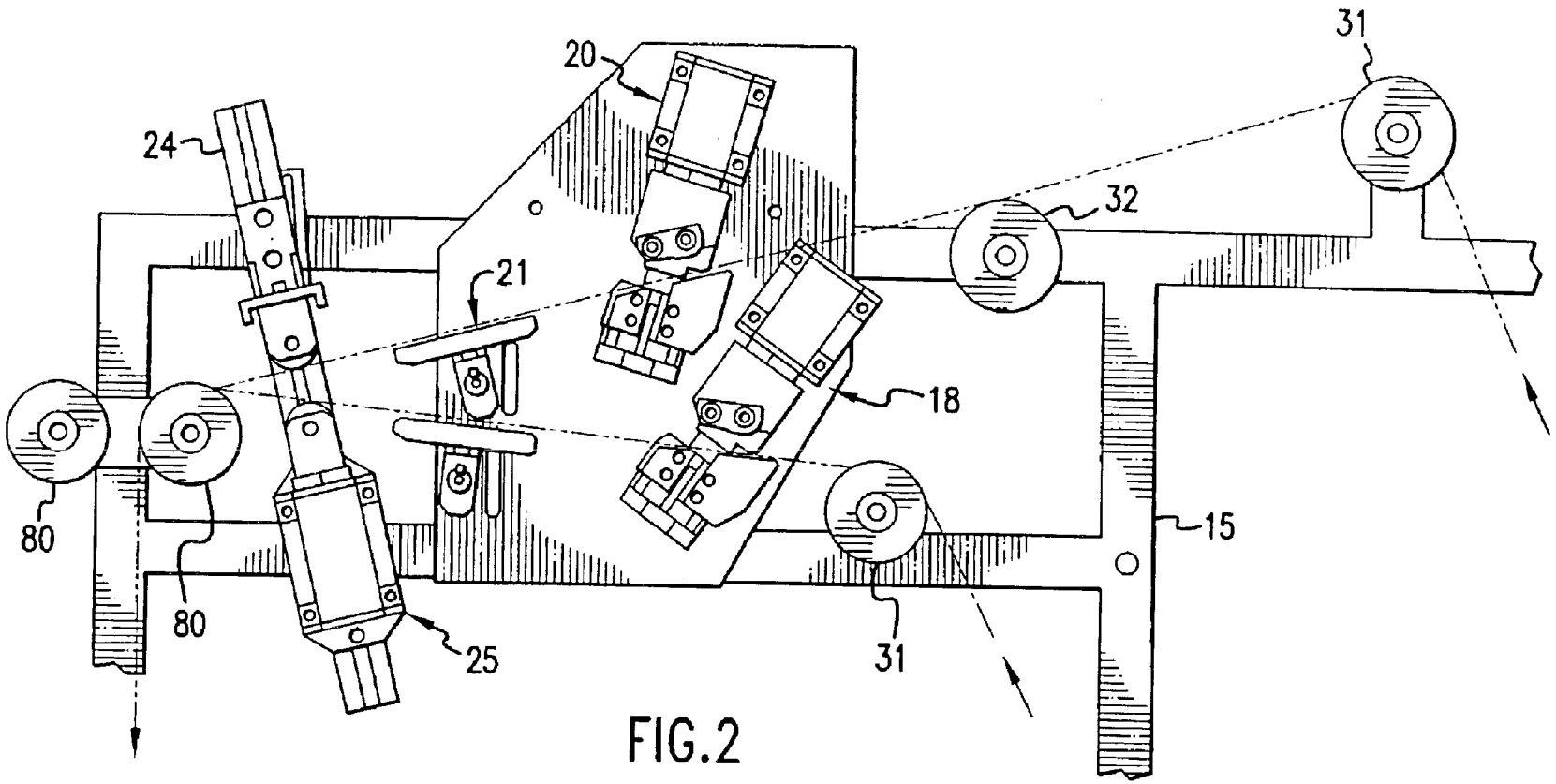
FIG. 2 is an elevational view of the splicing station of the apparatus shown in FIG. 1.
Figure 3:
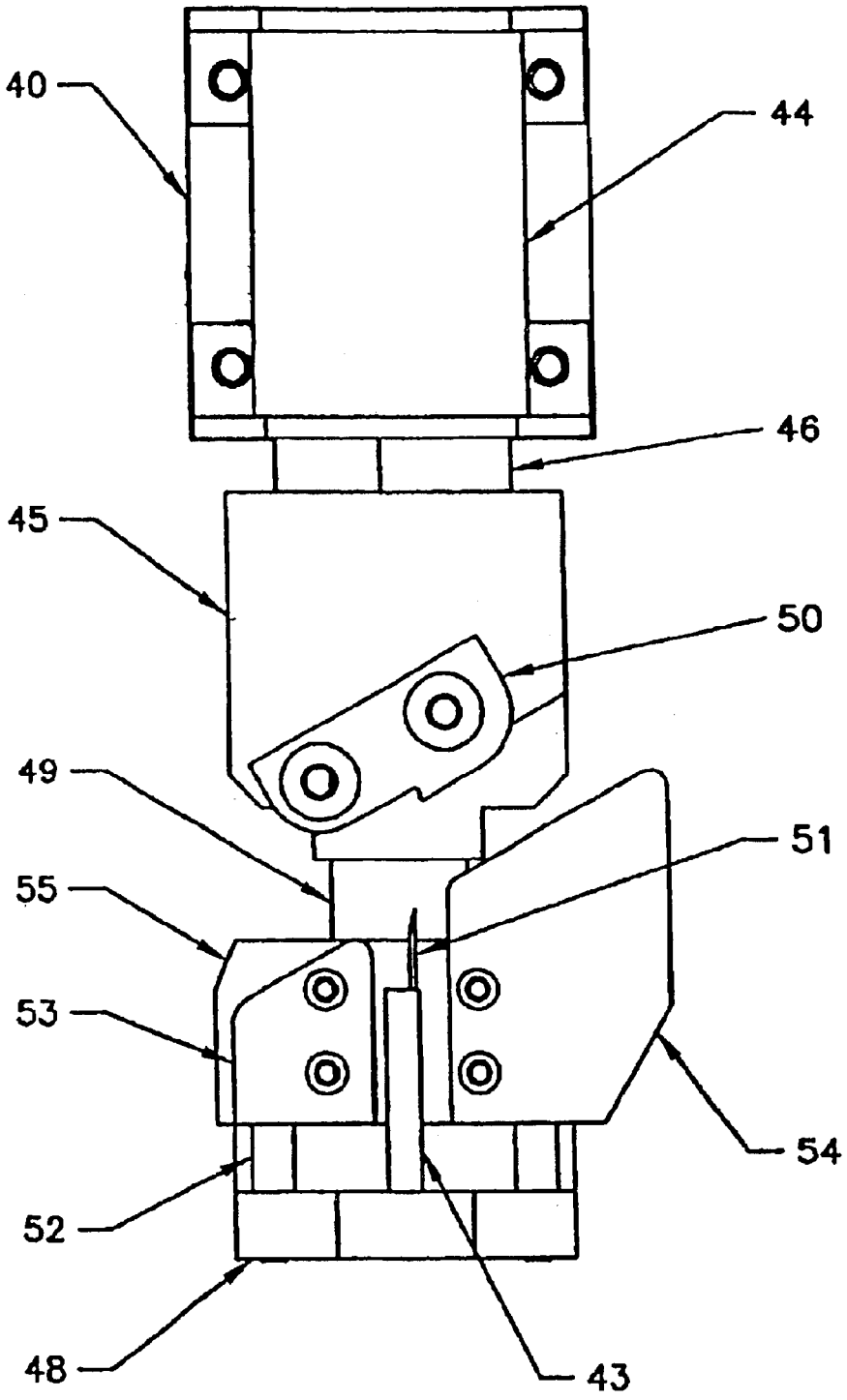
FIG. 3 is an elevational view of the cutting knife element of the apparatus.

A knife element 20 is illustrated in FIG. 3, and is shown in perspective in FIG. 1. Knife elements 18 and 20 are similar. A knife element includes a support plate 40, mounted on the support plate 16, which supports, on pins or posts 41, a motor (not shown). In the illustrated embodiment the motor is a pneumatic cylinder 44. The motor drives a block 45, via a drive piston support and adjustable nut 46, toward a fixed lower plate 48 attached by plate 49 to the support plate 40, with the block 45 attached. The block 45 carries an anvil 50 that comes into contact with a cutting blade that includes a fixed knife blade 51 projecting from a holder 43 mounted on the plate 48. The knife blade 51 is guarded by a pair of blocks 53 and 54 positioned on opposite sides of the blade 51 to protect the operator threading the tape of the second supply roll 10 through the knife element 20. The blocks 53, 54 are moved downward to expose the knife blade 51 as the anvil 50 forces the tape of the exhausted roll into the knife blade 51. The surfaces of the anvil 50 and blocks 53, 54 adjacent the tape path are coated with a release coat, for example, silicone, (in the form of, e.g., a strip of release coated tape on a layer of release composition coating the block), to prevent the adhesive on the tape from sticking to the surfaces. The upper surface of the block 54 is provided with a series of holes connected to a vacuum hose as will be described later. The surface of the block 54 holds the end of the cut supply web. The blocks 53, 54, on their slide block 55 are in line with the tape path, and are biased, by springs 52, upward from the plate 48 to a position guarding the knife blade 51.

From the knife elements 18 and 20, described above, the second tape is placed on a staging plate 21 or 22 that includes a plate and rails that form an open troughshaped member having a series of holes along the flat base of the plate, which are in communication with a vacuum line or a source of subatmospheric pressure. The vacuum lines are always open and operational. The staging plates 21 and 22 are only active when the tape is inactive, i.e. awaiting the splicing step. When on the staging plate 22, a splicing tape is adhered to the free end of the second supply tape. The splicing tape is a length of pressure sensitive tape that includes a film backing and a pressure sensitive adhesive disposed on one surface of the backing. The splicing tape is approximately 6 inches (15 cm) in length, with half of its length adhered to and adjacent to the free end of the standby tape and the other half extending beyond the free end of the standby tape and extending from the staging plate between the nip area of the splicing rollers of the splicing element 25. The staging plates 21, 22 are supported from the support plate 16 by brackets cantilevered from the plate with the hoses of the pneumatic system extending therefrom to the staging plates 21, 22. Useful pressure sensitive adhesive compositions include, for example, hot melt, solvent based, and water-based pressure sensitive adhesive compositions.

In each of the splicing positions, i.e. with the second tape on the staging plate 21 or 22, the adhesive surface of the splicing tape is directed inward of the two tapes. In this position the extended length of the splicing tape will engage the paper liner of the supply tape traveling over the staging plate 21 when forced into contact at the nip of the splicing rollers. When the second supply tape is staged on the plate 21, the adhesive surface of the splicing tape is in engagement with the adhesive layer on the second tape, such that it covers the tacky adhesive of the second tape. At the nip of the splicing rollers of the splicing element 25, the adhesive on the splicing tape engages the adhesive of the supply tape and makes the splice. The knife element 18 simultaneously cuts the nearly exhausted supply tape.

Figure 4:
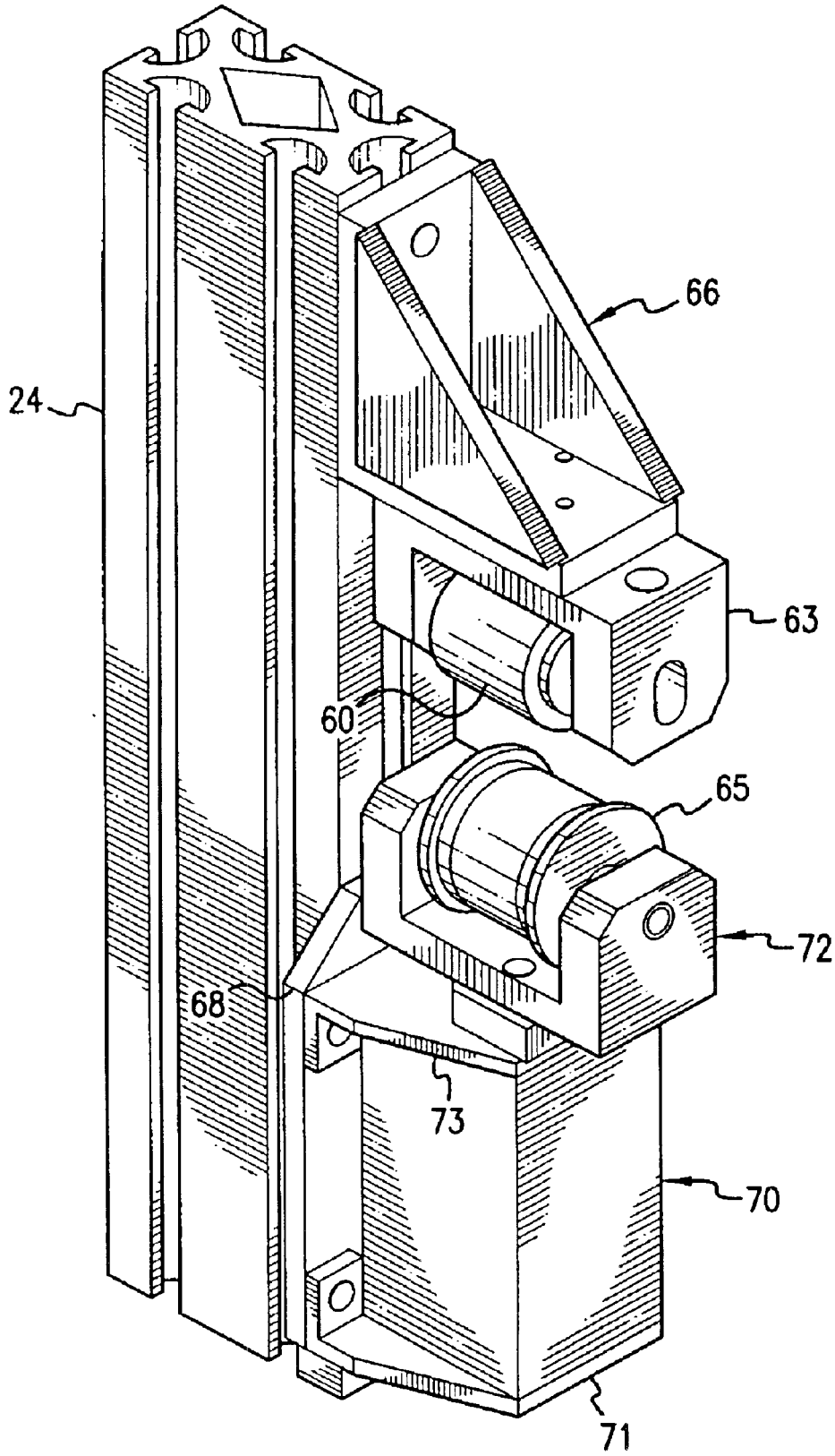
FIG. 4 is a perspective view of the splicing rollers of the apparatus.

The splicing area includes splicing element 25 illustrated in FIG. 4. The splicing element 25 consists of at least a pair of rollers 60, 65, normally positioned in spaced relationship. The upper roller 60, as illustrated, is supported in a U-shaped bracket 63 and has its trunnions or supporting axle positioned in slotted openings in the ends of the U-shaped bracket 63. Springs are provided to support the roller 60 such that it can move radially in relationship to the bracket 63 when making impact with the movable roller 65, such that variations in the tape thickness do not damage or cause any deleterious effect to the splicing element 25. A gusset bracket 66 supports the U-shaped bracket 63 from the support bar 24, and affords adjustment of the roller position. The roller 60 has a release coat to impede and preferably prevent the adhesive from sticking to the roller 60.

The splicing element 25 further includes a movable pinch roller 65, reciprocatably driven by a motor means 70 sitting on a fixed mounting plate 71. The roller 65 is forced upward by the motor 70, which is a pneumatic cylinder. The upward movement brings the rollers 65 and 60 into engagement for a time sufficient to bring the splicing tape and the supply tape into intimate contact to make the splice. The rollers 60, 65 are then separated. Roller 65 is carried by a U-shaped bracket 72 supported for movement with the piston of the motor 70 above the plate 73 resting at the top of the motor 70. A support plate 68 attaches the motor 70 to the extrusion 24. The roller 65 has raised flanges at the ends of the roller to prevent the adhesive from squeezing out axially when the rollers 60, 65 are forced toward engagement with each other.

The supply tape and the spliced tape leave the splicing area 25 and are directed over a first of a pair of "apple core pulleys" 80 and toward tensioning pulley system where the tape is festooned about pulleys that serve to maintain a given tension on the tape before and immediately after splicing the tape as it is advanced toward a receptive substrate and under an application roller 85. The supply web advances past the pulley 80 and is rotated 180 degrees around a festoon pulley 81. The festoon pulley 81 slides up and down the support to provide the proper tension in the tape as it is advanced upward around the second pulley 80 and downward toward the applicating roller 85 supported from a tape applicator arm 84. This festooning allows the tape to be slowed during splicing.

The web passing through the system is referred to as a "transfer tape." The transfer tape is the tape to be spliced. It includes a backing, a release coating on at least one side, preferably both sides, and an adhesive composition disposed on a release coated side of the backing. The release coating allows the backing, which is preferably paper, to be removed from the adhesive after the tape is applied to the receptive substrate. The adhesive is preferably a tacky hot melt adhesive. The backing is paper, polymeric film, or a coated release paper. The peel strength of the adhesive to the backing is such that the adhesive will not separate from the backing when the tapes are spliced together. The adhesive, itself, does not have a lot of internal strength and the splicing tape holds the tapes together during the initial splicing of the standby roll to the supply roll.

Useful tacky adhesives include, for example, hot melt adhesives, hot melt remoistenable adhesives, water dispersible hot melt adhesives, biodegradable hot melt adhesive and repulpable hot melt adhesives. Examples of these adhesives include hot melt adhesives such as an ethylene-vinyl acetate-based hot melt adhesive; ethylene methylacrylate-based hot melt adhesive; ethylene n-butyl acrylate-based hot melt adhesive; hot melt adhesives based on polyethylene and polypropylene homopolymers, copolymers and interpolymers, rubbery block copolymer hot melt adhesives, and combinations thereof.

Examples of useful adhesives for the splicing tape include hot melt pressure sensitive adhesives such as a metallocene based hot melt pressure sensitive adhesive such as those that include a homogeneous linear or substantially linear interpolymer of ethylene and a $C_3$ to $C_{20}$ alpha-olefin; ethylene methylacrylate-based hot melt pressure sensitive adhesive, water-based pressure sensitive adhesives such as acrylic, styrene-acrylic, and polyvinyl acetate, vinyl acetate-ethylene copolymers and starchbased adhesives. One example of a useful adhesive is HM-1902 (available from H.B. Fuller Company, St. Paul, Minn.). An example of a useful pressure sensitive adhesive coated tape is Tape 444, (available from Minnesota Mining and Manufacturing Company, St. Paul, Minn.).

Figure 6:
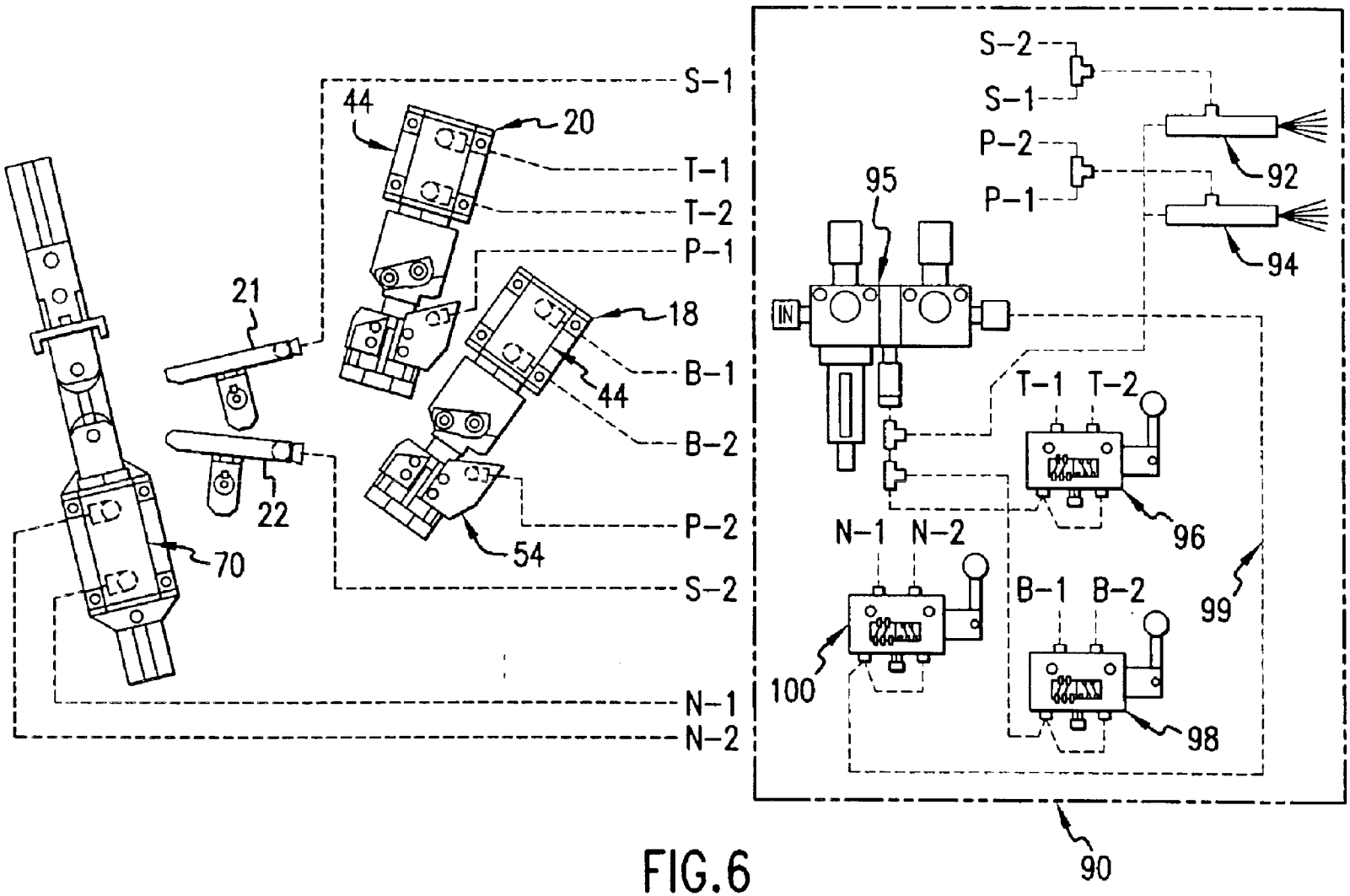
FIG. 6 is a detail view of the control panel for the pneumatically controlled elements of the splicing apparatus and how they are coupled.

FIG. 6 illustrates the control panel 90 in association with the operating motors of the splicing system. Pneumatic pressure is provided to a pair of units 92 and 94 that are connected by hoses to exhaust air from the staging plates 21 and 22 and from the surfaces of the blocks 54 of the knives 18 and 20. Pressurized air is furnished to an accumulator 95 and is directed therefrom to a first "T" directing the same to units 92 and 94, and to a second "T" directing the air to a control valve 96 to operate the motor 44 of the cutter 20, and to a valve 98, which operates the motor 44 of cutter 20. Air of a lower pressure is directed via a line 99 to a valve 100, which operates the motor 70 at the splicing area 25. The outputs from the valves 96, 98, and 100 are connected to the lines indicated by reference numerals T-1, T-2, B-1, B-2, N-1, and N-2, respectively. Pressurized air is directed by the valves into one end of the motors or into the other end as required to perform the operations indicated above. The pneumatic valves and the operation of the splicing unit can be controlled by the use of sensors on the tape, which can signal the approaching of the end of the supply tape and sequence the splicing of the standby tape to the supply tape as discussed above. The signaling can be directed to a PLC, which can interface with the pneumatic system to control the sequencing.

Having described the invention with reference to accompanying illustrations of the apparatus of the present invention, and the method by which the splicing of the tapes are accomplished, it is to be understood that changes in the apparatus are contemplated and engineering changes can be made without departing from the spirit or scope of the invention as set forth in the appended claims.

Other embodiments are within the claims.

What is claimed is:

1. A splicing system configured to splice successive rolls of supply web comprising:

a first spindle configured to support a first supply roll comprising a first web material;

a second spindle configured to support a second supply roll comprising a second web material; and a splicing station comprising:

a first knife element configured to cut the first web material;

a second knife element configured to cut the second web material;

a first staging area configured to hold an end portion of the first web material in a fixed position;

a second staging area configured to hold an end portion of the second web material in a fixed position; and a pair of pinch rollers configured to form a splice; between the first web material and the end portion of the second web material or between the second web material and the end portion of the first web material, wherein the pair of pinch rollers are spaced apart and form the splice by coming together.

2. The splicing system of claim 1, further comprising a first series of rollers for placing a reverse curl in the first web material and a second series of rollers for placing a reverse curl in the second web material.

3. The splicing system of claim 2, wherein the first series of rollers comprises a first upstream roller and a first downstream roller, the second series of rollers comprises a second upstream roller and a second downstream roller, the first upstream roller is upstream of the first downstream roller relative to the first web material as it moves along a first path, the second upstream roller is upstream of the second downstream roller relative to the second web material as it moves along a second path, the first upstream roller and the first downstream roller are concave to guide the first web material along the first path, and the second upstream roller and the second downstream roller are concave to guide the second web material along the second path.

4. The splicing system of claim 3, wherein the first upstream roller has a first upstream roller concave portion, the first downstream roller has a first downstream roller concave portion, the second upstream roller has a second upstream roller concave portion, the second downstream roller has a second downstream roller concave portion, the first downstream roller concave portion defines a narrower channel than the first upstream roller concave portion, and the second downstream roller concave portion defines a narrower channel than the second upstream roller concave portion.

5. The splicing system of claim 1, wherein the first staging area comprises a first plate and the second staging area comprises a second plate.

6. The splicing system of claim 5, wherein the first plate has a series of holes for placing subatmospheric pressure on a surface of the first web material and the second plate has a series of holes for placing subatmospheric pressure on a surface of the second web material.

7. The splicing system of claim 1, wherein the pair of pinch rollers comprises an upper roller and a lower roller and the upper roller and/or the lower roller is attached to a spring that compresses when the pair of rollers come together to form the splice.

8. The splicing system of claim 1, further comprising the first supply roll comprising the first web material, the second supply roll comprising the second web material, and a piece of splicing tape positioned on the end portion of the first web material or the end portion of the second web material, wherein the piece of splicing tape has an unattached portion that extends between the pair of pinch rollers to aid in forming the splice.

9. The splicing system of claim 8, wherein the piece of splicing tape comprises pressure sensitive adhesive.

10. The splicing system of claim 1, further comprising a tape applicator configured to receive the spliced web material and apply the spliced web material to a substrate.

11. The splicing system of claim 1, further comprising the first supply roll comprising the first web material and the second supply roll comprising the second web material, wherein the first web material and/or the second web material comprises a backing.

12. The splicing system of claim 11, wherein the backing has a surface and at least a portion of the surface is coated with a release coating.

13. The splicing system of claim 1, further comprising the first supply roll comprising the first web material and the second supply roll comprising the second web material, wherein the first web material and/or the second web material comprises a paper backing.

14. The splicing system of claim 1, further comprising the first supply roll comprising the first web material and the second supply roll comprising the second web material, wherein the first web material and/or the second web material comprises a tacky adhesive.

15. The splicing system of claim 14, wherein the tacky adhesive is selected from the group consisting of hot melt adhesive, hot melt remoistenable adhesive, water dispersible hot melt adhesive, biodegradable hot melt adhesive, and repulpable hot melt adhesive.

16. The splicing system of claim 1, wherein the first staging area is substantially fixed against movement in a first pull direction, the second staging area is substantially fixed against movement in a second pull direction, the first pull direction is a direction in which the end portion of the first web material moves immediately after it is spliced to the second web material, and the second pull direction is a direction in which the end portion of the second web material moves immediately after it is spliced to the first web material.

17. The splicing system of claim 1, further comprising a festoon pulley that slides along a support to control the tension on the first web material or the second web material.

18. A splicing system capable of splicing successive rolls of supply web, comprising:

a first and second spindle configured for supporting a first and second roll of web material, respectively, and for directing the first and second web materials toward at least one splicing station;

the splicing station comprising at least one knife element for cutting the first or second web material as it passes through the splicing station; at least one staging area where successive ends of the first or second web material can be placed and held for splicing; and rollers positioned one on each side of the first or second web material for closing on the first or second web material to form a splice; and a control capable of simultaneously closing the rollers on the first or second web material and actuating the knife element to cut the first or second web material, wherein the knife element comprises a fixed cutting blade; an anvil for pressing the first or second web material against the fixed cutting blade; and a knife element motor configured to move the anvil against the first or second web material and withdraw the anvil from the first or second web material.

19. The splicing system of claim 18, wherein the fixed cutting blade is positioned between two blocks, the blocks and the anvil each have surfaces adjacent to the first or second web material, the surfaces of the blocks and anvil are at least partially coated with a release agent to prevent the first or second web material from sticking to the surfaces of the blocks and anvil, and the blocks are capable of retracting to expose the fixed cutting blade when the blocks are engaged by the anvil.

20. The splicing system of claim 18, wherein the rollers comprise a pair of rollers spaced apart on either side of the first or second web material, and the splicing system further comprises a roller motor configured to move the rollers toward one another to splice the first or second web material.

21. The splicing system of claim 18, further comprising the first supply roll comprising the first web material, the second supply roll comprising the second web material, and a piece of splicing tape positioned on the free end of the first or second web material, wherein the piece of splicing tape extends between the rollers to aid in forming the splice.

22. A splicing station, comprising:

a first knife element configured to cut a first web material;

a second knife element configured to cut a second web material;

a first staging plate configured to hold an end portion of the first web material in a fixed position;

a second staging plate configured to hold an end portion of the second web material in a fixed position; and a pair of pinch rollers configured to form a splice between the first web material and the end portion of the second web material or between the second web material and the end portion of the first web material, wherein the pair of pinch rollers are spaced apart and form the splice by coming together.

23. The splicing station of claim 22, wherein the first staging plate has a series of holes for placing subatmospheric pressure on a surface of the first web material and the second staging plate has a series of holes for placing subatmospheric pressure on a surface of the second web material.

24. The splicing system of claim 22, further comprising a festoon pulley that slides along a support to control the tension of the first web material or the second web material.

* * * * *